US005186108A

United States Patent [19]

Hillebrand

[11] Patent Number: 5,186,108

[45] Date of Patent: Feb. 16, 1993

[54] AXIALLY ADJUSTABLE REGISTER PIN

[75] Inventor: Bernd A. Hillebrand, Bergrheinfeld, Fed. Rep. of Germany

[73] Assignee: Koenig & Bauer Aktiengesellschaft, Wurzburg, Fed. Rep. of Germany

[21] Appl. No.: 802,401

[22] Filed: Dec. 4, 1991

[30] Foreign Application Priority Data

Dec. 6, 1990 [DE] Fed. Rep. of Germany ..... 4038919

[51] Int. Cl.[5] ..... B41F 27/06; B41F 27/12

[52] U.S. Cl. ..... 101/415.1

[58] Field of Search ..... 101/415.1, 378, DIG. 36; 51/364, 367, 368; 33/617, 618, 621

[56] References Cited

U.S. PATENT DOCUMENTS 5,005,477 4/1991 Schroeder ..... 101/415.1

FOREIGN PATENT DOCUMENTS 2045953 10/1981 Fed. Rep. of Germany .

3545297 7/1987 Fed. Rep. of Germany .

*Primary Examiner*—J. Reed Fisher

*Attorney, Agent, or Firm*—Jones, Tullar & Cooper

[57] ABSTRACT

An axially adjustable register pin for a plate cylinder of a rotary printing machine is positioned in a recess in an insertion bar that is carried in a cylinder gap on the periphery of the plate cylinder. The register pin is axially slidable and is held in a selected position by holding devices that are attached to the insertion bar. Each holding device has a cantilever arm and the register pin has lower arms that engage the undersurfaces of the cantilever arms. Set screws are used to hold the lower arms against the cantilever arms.

3 Claims, 3 Drawing Sheets

AXIALLY ADJUSTABLE REGISTER PIN

FIELD OF THE INVENTION

The present invention is directed generally to an axially adjustable register pin. More particularly, the present invention is directed to an axially adjustable register pin for a plate cylinder of a rotary printing press. Most specifically, the present invention is directed to an axially adjustable register pin assembly including a clamping or holding assembly for fixing the portion of the axially adjustable register pin. The register pin has an upper register position which is engageable with register slots in the leading and trailing edges of a printing plate secured to the plate cylinder; and a fastening portion that is receivable in an axially extending slot in an insertion bar that is received in a cylinder gap in the periphery of the plate cylinder. The fastening portion carries set screws that are operable to axially fix the register pin at a desired location in the cylinder gap of the plate cylinder.

DESCRIPTION OF THE PRIOR ART

Many printing operations are accomplished by passing an elongated paper web through a series of rotary printing units which together form a rotary press assembly. This is frequently the situation when the paper web being printed is to have multiple colors or types of printing steps performed on it. In such rotary presses that have several axially arranged printing units, it is often the case that the printed paper web changes its width from printing unit to printng unit. Such changes in width are often caused by absorption of dampening fluid during the printing operation and by other changes in the state of the paper. These width variations in the paper web, can cause printing errors and register errors.

Various attempts have been made to provide axially shiftable register pins so that the position of the printing plate on the surface of the plate cylinder can be shifted axially to compensate for paper web width changes. In one prior device that is set forth in German published unexamined patent application No. 3,545,297 the register pins for two printing plates that are arranged adjacent each other on a plate cylinder can be axially shifted by means of a side register adjusting device. Each of the register pins is linked to each other by means of an adjusting bar or an adjusting tubular shaft by means of threads having different pitches. This adjusting bar or shaft is rotatable by an adjusting screw.

In a device of the type set forth in this prior arrangement the register pins for the two printing plates which are positioned adjacent each other always have to be adjusted simultaneously and both at the same rate. It is not possible to attain better printing quality by effecting the adjustment of only one of the register pins with a device of this type. A connecting bar between the register pin and the adjusting screw has a substantial length which is required to reach the adjustable register pins that are located near the middle of the cylinder. This long connecting bar requires suitable guide bushings and supports so that register accuracy does not diminish with increasing distance from the adjusting screw. The resultant adjusting assembly is quite complicated in construction and requires a significant amount of space. It thus is costly to manufacture and increases the size and complexity of the plate cylinder.

An alternative assembly that is intended for use in plate registry is shown in German published unexamined patent application No. 2,045,953. This device provides a stop in the plate cylinder gap. This stop is positioned at one end of the gap and is in the form of a clamping bushing which engages one side or end of the printing plate. Since this device contacts only one side edge of the printing plate, the plate is secured against lateral movement in only one direction. With this type of assembly, it is not possible to facilitate a lateral positioning of both sides of the printing plate at the same time. In this prior device, it is also not possible to use the stop as a register pin. The stop, since it is in the form of a clamping bushing changes its external shape during clamping. Thus a measurement, taken before clamping of the bushing, will be changed by the clamping itself.

It will thus be seen that a need exists for an axially adjustable register pin assembly that overcomes the limitations of the prior devices. The axially adjustable register pin assembly in accordance with the present invention provides such a device and is a substantial improvement over the prior devices.

SUMMARY OF THE INVENTION

It is an object of the present invention to provide an axially adjustable register pin.

Another object of the present invention is to provide an axially adjustable register pin for a plate cylinder of a rotary press.

A further object of the present invention is to provide an axially adjustable register pin for a plate cylinder in which the register pin can be fixed in place separately.

Yet another object of the present invention is to provide an axially adjustable register pin that is positionably secured in a cylinder gap of a plate cylinder.

Still a further object of the present invention is to provide an axially adjustable register pin that is securable by a pair of spaced holding devices.

Even yet another object of the present invention is to provide an axially adjustable register pin that is adjustable along an insertion bar carried in the cylinder gap of a plate cylinder.

As will be discussed in greater detail in the description of the preferred embodiment which is presented subsequently, the axially adjustable register pin in accordance with the present invention includes a register portion and a fastening portion. The register portion has opposing register ends that are received in register slots in the leading and trailing ends of a printing plate that is clamped to the surface of the plate cylinder. The fastening portion of the register pin includes two outwardly directed fastening ends. Each end is held beneath a cantilever or projection on a holding device. The holding devices are, in turn, secured in a gap in an insertion bar positioned in the cylinder gap of the plate cylinder. Each fastening end of the register pin carries a set screw that is accessible through an elongated slot in the overlying cantilever arm of the holding device. The set screws can be loosened to allow the register pin to be slid axially in the gap in the insertion bar. Once the register pin has been properly located, the set screws are tightened to hold the register pin in place.

A significant advantage of the axially adjustable register pin of the present invention is that each printing plate can be laterally repositioned individually without shifting or displacing the entire printing plate device. The axially adjustable register pin of the present invention does not utilize lengthy screws or adjusting bars and is not expensive to manufacture or maintain. It can be used with plate cylinders having bearer rings as well as plate cylinders without bearer rings.

The axially adjustable register pin in accordance with the present invention overcomes the limitations of the prior devices and is a significant advance in the art.

BRIEF DESCRIPTION OF THE DRAWINGS

While the novel features of the axially adjustable register pin assembly in accordance with the present invention are set forth with particularity in the appended claims, a full and complete understanding of the invention may be had by referring to the detailed description of the preferred embodiment which is presented subsequently, and as illustrated in the accompanying drawings in which:

DESCRIPTION OF THE PREFERRED EMBODIMENT

Figure 1:
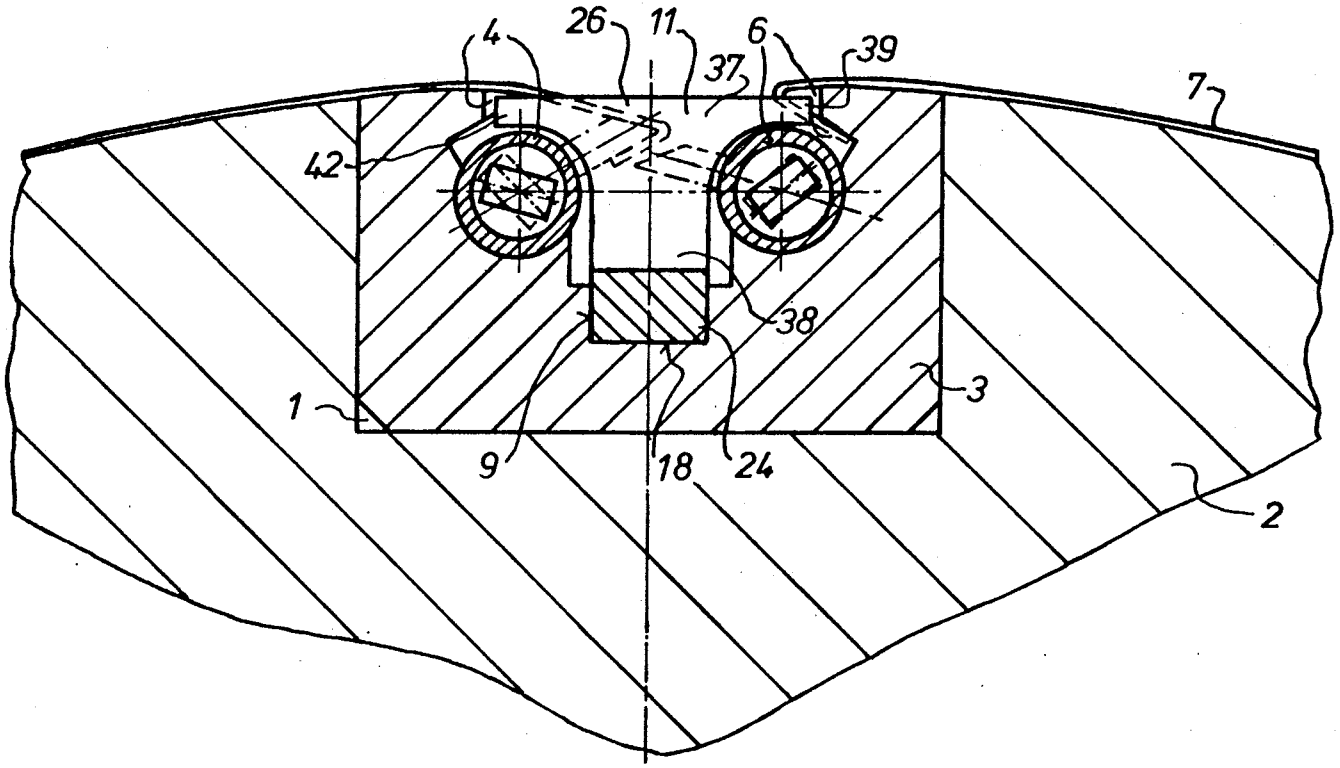
FIG. 1 is cross-sectional side elevation view of an axially adjustable register pin assembly in accordance with the present invention positioned for use in a cylinder gap of a plate cylinder.

Referring initially to FIG. 1, there may be seen a preferred embodiment of an axially adjustable register pin assembly in accordance with the present invention. A plate cylinder 2 of a rotary printing press is provided with a generally conventional, axially extending cylinder gap 1 at its periphery. An insertion bar 3 is securely positioned in the cylinder gap 1 and carries a pair of generally parallel, axially extending and circumferentially spaced printing plate end clamping and fixing devices 4 and 6. These plate end clamping devices 4 and 6 are rotatable in either direction in a generally known manner to clamp and fix the leading and trailing ends of a printing plate 7 which is to be secured to the outer peripheral surface of the plate cylinder 2. The insertion bar 3 can be removed from the cylinder gap 1 and is held in place by suitable means that are not specifically shown.

Figure 2:
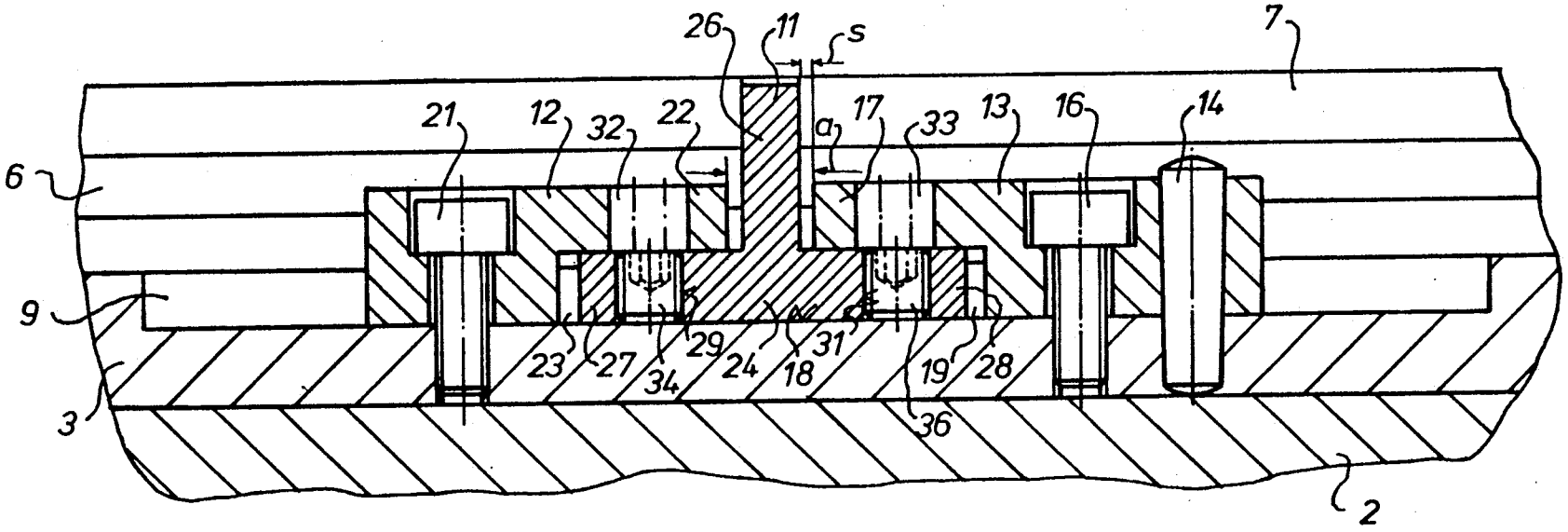
FIG. 2 is cross-sectional view of the register pin positioned in the cylinder gap and taken along the axial direction of the cylinder gap.
Figure 3:
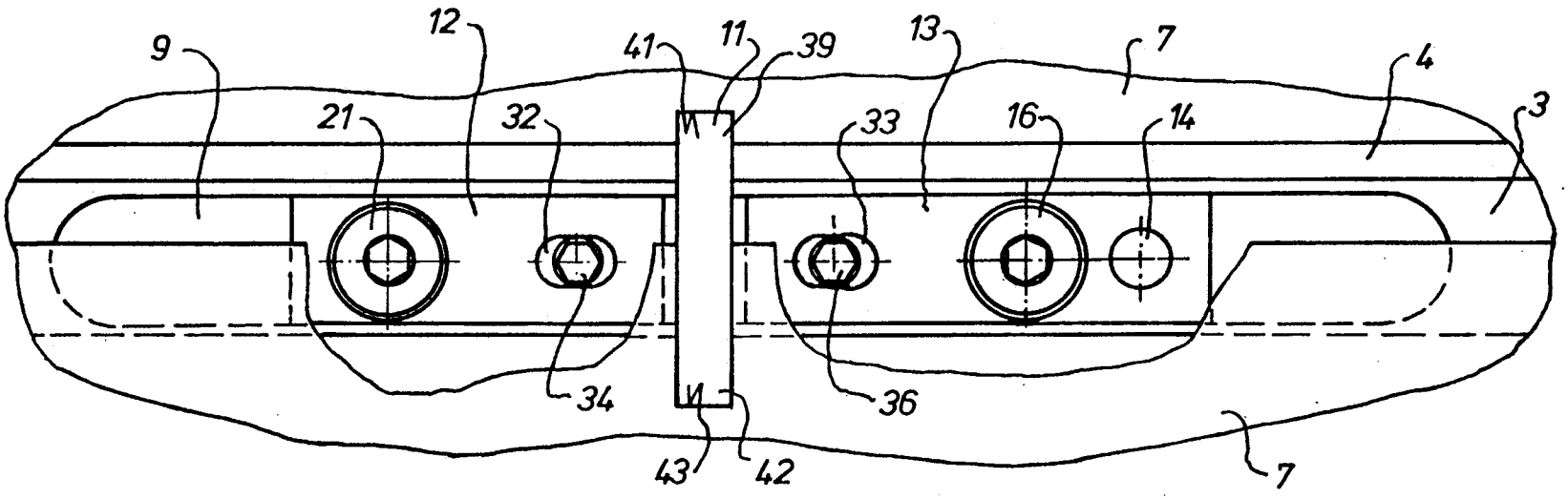
FIG. 3 is a top plan view of the axially adjustable register pin in accordance with the present invention.

One or more printing plates 7 may be attached to the insertion bar 3 and held in place on the plate cylinder 2. One or more recesses or openings 9 are provided in the insertion bar 3 with the shape of each such recess being best seen in FIG. 3. Each recess is structured to receive an axially adjustable register pin, generally at 11, in accordance with the present invention. A pair of spaced register pin holding devices, generally at 12 and 13 as seen most clearly in FIGS. 2 and 3 are provided to axially adjustably position each register pin 11. It will be understood that the insertion bar 3 could have a suitable aperture instead of a recess 9 and that the register pin could be secured directly to the plate cylinder body 2.

As may be seen by referring to FIGS. 1 and 2, the register pin 11 has an upper register portion 26 and a lower fastening portion 24. The lower fastening portion 24 cooperates with the register pin holding devices 12 and 13, as may be seen most clearly in FIGS. 2 and 3. The right holding device 13 is generally a rectangular block that has a first cantilever arm or projection 17 which extends toward the register pin 11 and which overlies a right end 28 of the fastening portion 24 of the register pin 11. A tapered pin 14 extends through the rectangular body of the right holding device 13 and is received in a suitable opening in the insertion bar 3. The cantilever projection 17 cooperates with a bottom surface 18 of the insertion bar 3 to form a guide slot 19 for the right lower arm 28 of the fastening portion 24 of the register pin 11. The right holding device 13 is secured to the insertion bar 3 by use of a threaded fastening screw 16 that passes through the rectangular body generally adjacent the taper pin 14.

The left holding device 12 is structured essentially the same as the right holding device 13. It has a generally rectangular body which carries a threaded fastening screw 21 that is used to secure the left holding device 12 to the insertion bar 3. A left cantilever arm or projection 22 overlies a left lower arm 27 of the fastening portion 24 of the register pin 11. This left cantilever arm 22 is spaced from, and cooperates with the bottom surface 18 of the insertion bar 3 to form a left guide slot 23 in which the left lower arm 27 of the register pin 11 is slidable.

The two holding devices 12 and 13 are positioned in the recess 9 of the insertion bar 3 so that there is maintained a space "a" between the free ends of the cantilever arms 17 and 22 of generally about 6 mm. It is within this space "a" that the register pin 11 is axially slidable. As may be seen most clearly in FIG. 3, the circumferential width of the recess 9 in the insertion bar 3 is generally the same as the width of the rectangular bodies of the two holding devices 12 and 13. This prevents the holding devices from moving circumferentially in the recess 9.

As may be seen most clearly in FIG. 2, and has been alluded to above, the register pin 11 is generally shaped as an inverted T in a cross-section taken in the axial direction of the plate cylinder 2. The fastening portion 24 is formed by the lower left and right arm 27 and 28 while the register portion 26 extends upwardly toward the surface of the plate cylinder 2. As was discussed previously, the lower left and right arms 27 and 28 are positioned in left and right guide slots 23 and 19, respectively and allow the register portion 26 to slide axially in the gap or space "a" between the free ends of the left and right cantilever arms 22 and 17.

Each of the lower left and right arms 27 and 28 of the fastening portion 24 of the register pin 11 has a threaded tap hole 29 and 31 respectively. These tap holes each carry a threaded set screw 34 or 36. A bottom portion of each set screw 34 or 36 is engageable with the bottom 18 of the insertion bar 3. The upper ends of the set screws 34 and 36 are accessible through elongated holes or slots 32 and 33 in the left and right cantilever arms 22 and 17 of the left and right holding devices 12 and 13. As may be seen in FIG. 3, the elongated slots 32 and 33 have sufficient length so that the set screws 34 and 36 can be engaged even if the register pin is slid all the way to the right or to the left.

Rotation of the set screws 34 and 36 in a downward or clockwise direction will raise the lower left and right arms 27 and 28 of the fastening portion 24 of the register pin 11 upwardly against the undersurfaces of the cantilever arms 22 and 17 of the left and right holding devices 12 and 13. The frictional forces between the engaging surfaces will hold the register pin in place. If the set screws 34 and 36 are backed off by being turned in a counterclockwise direction, the register pin 11 can be slid with respect to the holding devices 12 and 13. This sliding movement of the register pin 11 is limited by the spacing "a". In the preferred embodiment, the register portion 26 of the register pin has a thickness such that the register adjustment distance "s" is generally about 1 mm either to the left or to the right.

Referring again to FIG. 1, it will be seen that the register portion 26 of the register pin 11 is generally in the shape of an upright T with the horizontal upper part or bar of the T extending generally in the direction of rotation of the plate cylinder 2. The transitions between the horizontal upper bar 37 and the vertical leg 38 of the T-shaped register portion 26 of the register pin are generally rounded or arcuate and are shaped to engage the surfaces of the rotatable parts of the plate fixing and clamping devices 4 and 6.

A right upper register end 39 of the register portion 26 of the register pin is received in a register slot 41 on the leading edge of the printing plate, as may be seen in FIGS. 1 and 3. Similarly, a left upper register end 42 of the register portion 26 is received in a register slot 43 of the trailing or following edge of the printing plate 7.

When the register pin 11 of the present invention is to be adjusted axially to thereby accomplish an axial adjustment of the printing plate 7, the set screws 34 and 36 are loosened. A gauge having the thickness of the desired adjustment amount is slid between the side surface of the register portion 26 of the register pin 11 and the free end of either cantilever arm 22 or 17. The register pin 11 can then be slid to the desired location and held in place by tightening of the set screws 34 and 36.

While a preferred embodiment of an axially adjustable register pin in accordance with the present invention has been set forth fully and completely hereinabove, it will be apparent to one of skill in the art that various changes in, for example, the size of the plate cylinder, the length of the cylinder gap, the type of plate end clamping devices and the like can be made without departing from the true spirit and scope of the present invention which is accordingly to be limited only by the following claims.

What is claimed is:

1. An axially adjustable register pin assembly which is useable to axially shift and align a printing plate having register slots on its leading and trailing ends on a plate cylinder, said axially adjustable register pin assembly comprising:

an insertion bar positionable in a cylinder gap which extends axially along a peripheral surface of a plate cylinder;

a register pin slidably securable on said insertion bar, said register pin having an upper register portion and a lower fastening portion;

holding means secured to said insertion bar, said holding means engaging said fastening portion of said register pin, said holding means including spaced first and second cooperating holding devices, each of said holding devices having a cantilever arm, each said cantilever arm being spaced from, and cooperating with said insertion bar to form a guide slot for said fastening portion of said register pin; and means on said fastening portion to cause said fastening portion and said holding means to frictionally engage each other.

2. The axially adjustable register pin assembly of claim 1 wherein said first and second cantilever arms have free ends which are spaced from each other, and further wherein said register portion of said register pin is positioned between said free ends of said first and second cantilever arms.

3. The axially adjustable register pin assembly of claim 1 wherein said first and second cantilever arms have elongated slots and further wherein said fastening portion of said register pin includes first and second lower arms which are positioned in said guide slots and which carry set screws, each of said set screws being positioned beneath a cooperating one of said elongated slots in said first and second cantilever arms.

* * * * *